US011613987B2

(12) United States Patent
Jackson et al.

(10) Patent No.: US 11,613,987 B2
(45) Date of Patent: Mar. 28, 2023

(54) METHOD AND APPARATUS FOR ZONE TESTING A WELL

(71) Applicant: Tech Flo Consulting, LLC, Conroe, TX (US)

(72) Inventors: William J. Jackson, Conroe, TX (US); Erik J. Reissig, Conroe, TX (US); James L. Miller, II, Willis, TX (US)

(73) Assignee: Tech Flo Consulting, LLC, Conroe, TX (US)

( * ) Notice: Subject to any disclaimer, the term of this patent is extended or adjusted under 35 U.S.C. 154(b) by 51 days.

(21) Appl. No.: 17/393,125

(22) Filed: Aug. 3, 2021

(65) Prior Publication Data

US 2021/0363877 A1 Nov. 25, 2021

Related U.S. Application Data

(63) Continuation of application No. 16/355,666, filed on Mar. 15, 2019, now Pat. No. 11,078,778, which is a continuation of application No. 16/043,867, filed on Jul. 24, 2018, now abandoned, which is a continuation of application No. 14/829,602, filed on Aug. 18, 2015, now abandoned.

(51) Int. Cl.
*E21B 47/10* (2012.01)
*E21B 43/14* (2006.01)

(52) U.S. Cl.
CPC ..... *E21B 47/10* (2013.01); *E21B 43/14* (2013.01)

(58) Field of Classification Search
CPC ..... E21B 47/10; E21B 43/14
See application file for complete search history.

(56) References Cited

U.S. PATENT DOCUMENTS

| | | | | |
|---|---|---|---|---|
| 5,831,156 | A | 11/1998 | Mullins | |
| 5,955,666 | A | 9/1999 | Mullins | |
| 2003/0042048 | A1 | 3/2003 | Hughes et al. | |
| 2008/0302529 | A1* | 12/2008 | Fowler, Jr. | E21B 33/124 166/54.1 |
| 2009/0037112 | A1 | 2/2009 | Soliman et al. | |
| 2009/0250211 | A1 | 10/2009 | Craig | |
| 2013/0333879 | A1 | 12/2013 | Rasheed | |
| 2015/0167437 | A1 | 6/2015 | Dawson | |
| 2015/0176384 | A1 | 6/2015 | Castillo et al. | |
| 2015/0211339 | A1 | 7/2015 | Khan et al. | |

(Continued)

OTHER PUBLICATIONS

Padilla, Andrew V. and Jay Miller. "Locating and Controlling Water Production in Horizontal Wells (Permian Basin)." SouthWestern Petroleum Short Course (2000): pp. 220-225 & 326.

(Continued)

*Primary Examiner* — Dany E Akakpo
(74) *Attorney, Agent, or Firm* — Tumey L.L.P.

(57) ABSTRACT

A method for evaluating the potential effectiveness of refracking a previously fracked oil/gas well is accomplished by isolating a plurality of previously fracked zones of an oil/gas well in a formation and measuring the fluid flow rates from the isolated zones using a three phase flow meter positioned within the well at or near the previously fracked zones. The zones may be isolated by an isolation assembly which includes two packers connected by a perforated pipe and attached to a tubular positioned within the well.

17 Claims, 1 Drawing Sheet

(56) References Cited

U.S. PATENT DOCUMENTS

| | | | | |
|---|---|---|---|---|
| 2015/0369023 | A1 | 12/2015 | MacPhail et al. | |
| 2016/0356125 | A1* | 12/2016 | Bello | G06Q 10/04 |

OTHER PUBLICATIONS

International Search Report and Written Opinion for Application No. PCT/US16/41912 dated Oct. 2, 2016.
International Preliminary Report on Patentability for Application No. PCT/US2016/041912 dated Feb. 20, 2018.
USPTO Non-Final Office Action for U.S. Appl. No. 14/829,602 dated Jun. 22, 2017.
USPTO Final Office Action for U.S. Appl. No. 14/829,602 dated Oct. 27, 2017.
USPTO Non-Final Office Action for U.S. Appl. No. 16/043,867 dated Sep. 18, 2018.
USPTO Non-Final Office Action for U.S. Appl. No. 16/355,666 dated Jan. 8, 2020.
USPTO Notice of Allowance for U.S. Appl. No. 16/355,666 dated Apr. 27, 2021.
USPTO Notice of Allowance for U.S. Appl. No. 16/355,666 dated Apr. 1, 2021.
USPTO Final Office Action for U.S. Appl. No. 16/355,666 dated Oct. 1, 2020.

* cited by examiner

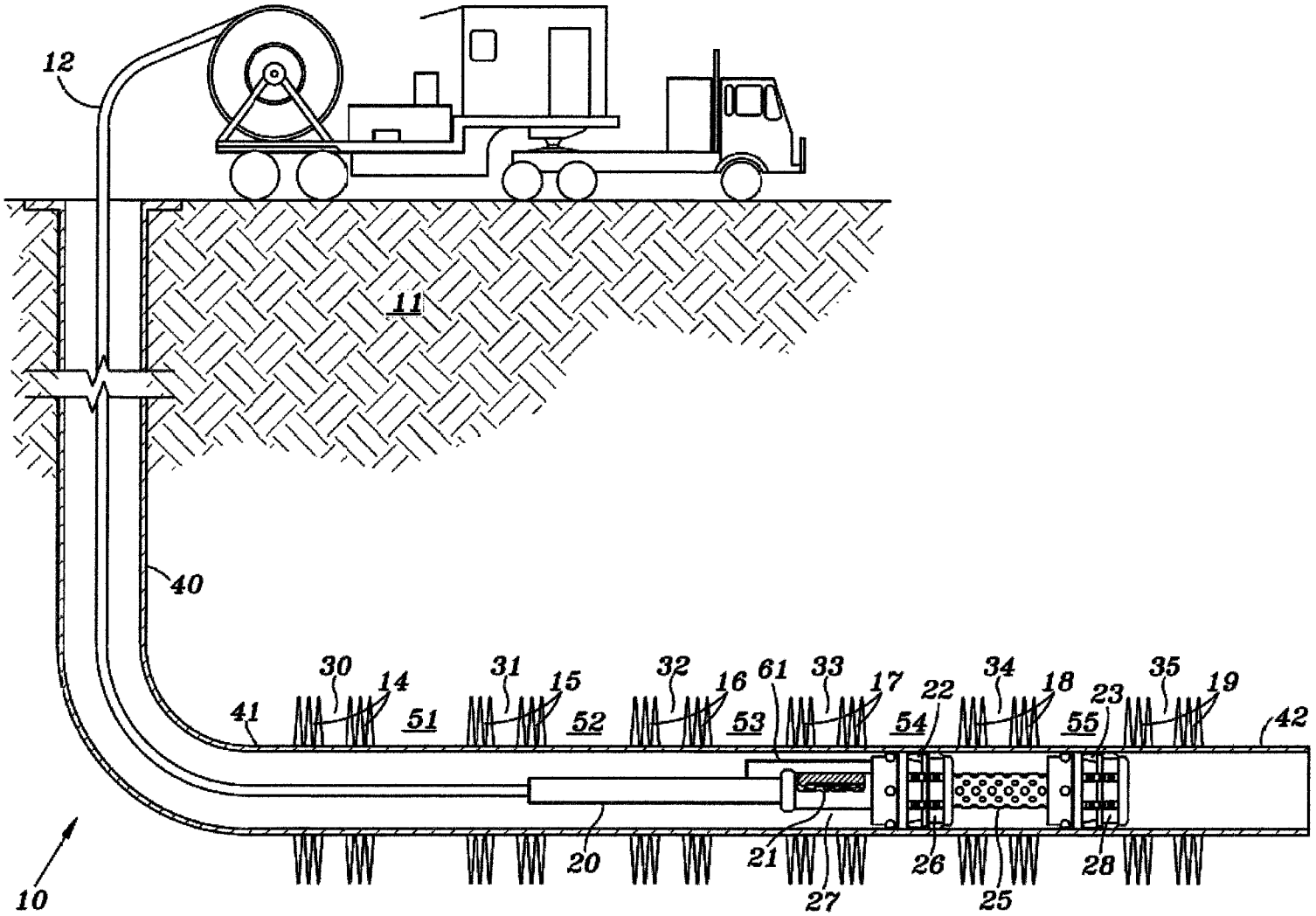
42
19
35
23
55
28
18
34
25
22
54
26
17
33
27
61
21
16
53
32
20
15
52
31
14
51
30
41
40
11
12
10

METHOD AND APPARATUS FOR ZONE TESTING A WELL

This application is a continuation of U.S. patent application Ser. No. 16/355,666 filed Mar. 15, 2019 which is a continuation of U.S. patent application Ser. No. 16/043,867 filed Jul. 24, 2018 which is a continuation of U.S. application Ser. No. 14/829,602 filed Aug. 18, 2015 the entire contents of which is hereby incorporated herein by reference thereto.

BACKGROUND OF THE INVENTION

Field of the Invention

This invention relates to a method and apparatus for evaluating the potential effectiveness of refracking an oil/gas well. Individual production zones are tested for flow rates of gas, water and oil to determine which previously fracked production zones are the most productive and consequently the best candidates for refracking.

Description of Related Arts Invention

Currently when refracking a well the overall productivity of the well is considered before a decision to refrack is made. Little is known about which of the many perforated zones are productive in a well. Therefore, a method of determining which of the zones could benefit from refracturing is very important.

Furthermore, while some efforts have been made to measure the total production of fluids within a well, very little effort has been made to monitor the individual production rates for gas, water, and oil as well as pressure and temperature at various stages of frack zones for the purpose of evaluating the effectiveness of refracking an individual zone using the proposed method and tool configuration in this application.

Consequently there is a need to for a more precise method of measuring the oil output of individual frack zones in order to evaluate the potential effectiveness of refracking a given production zone.

BRIEF SUMMARY OF SOME OF THE PREFERRED EMBODIMENTS

These and other needs in the art are addressed in one embodiment by isolating individual frack zones of a previously fracked formation and measuring the Static Bottom Hole Pressure and Flowing Bottom Hole Pressure, so a productivity index can be calculated and the ratio of Oil, Gas and Water can be measured through the use of a three phase flow meter, such as a Doppler flow meter. The production index is a measure of well's potential or ability to produce fluids as a function of reduction in pressure. The production index (PI) is calculated by subtracting the flowing bottom hole pressure (PF) from the static bottom hole pressure (PS) to get a drawdown pressure. The production rate in barrels per day (bpd) is divided by the drawdown to arrive at the PI. Thus if the drawdown pressure is 500 psi and the producing rate is 500 bpd, then the PI is 1.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawing in which:

The FIGURE illustrates a schematic showing of a horizontal well having a plurality of frack zones with an embodiment of equipment for carrying out the invention placed within the well.

DETAILED DESCRIPTION OF THE PREFERRED EMBODIMENTS

The FIGURE shows a well 10 within formation 11 including a casing having a horizontal portion 41 and a vertical portion 40 and a tubular string 12 which may be coiled tubing or jointed pipe tubing.

As shown the well includes a vertical section and a horizontal portion which terminates at 42. However it is understood that the well may consist of a vertical section only surrounded by a plurality of vertically spaced frack zones.

In a typical horizontally fracked well, there are a plurality of fracked zones 30, 31, 32, 33, 34, 35 wherein the casing 41 has been perforated at 14, 15, 16, 17, 18, and 19. As is known in the art, fracing fluids are introduced sequentially into the formation through the perforations in the casing to fracture the formation adjacent the casing to facilitate the flow of oil and other fluids from the formation to the interior of the well.

According to an embodiment of the invention, coiled or jointed pipe tubing 12 is lowered into the well and includes a jet pump section 20 and, a pup joint 27 having a three phase flow meter 21 located within the pup joint.

An isolation assembly which includes a first packer 26, a perforated sub 25, and a second packer 28 is attached to the tubing 12 at an end thereof via meter 27 and jet pump 21. When positioned within the well as shown in the FIGURE the isolation assembly will permit only fluid from previously fracked zone 34 to enter the interior of flow meter 21 via the openings in perforated sub 25. When inflatable packers are used, power fluid from the jet pump may be diverted to the packers via a conduit 61 for inflating the packers.

To measure the flow rate of fluids from zone 34, power fluid is delivered to jet pump 20 which will draw fluid from zone 34 through perforated sub 25, packer 26 and pup joint 27. Consequently the three phase flow meter 21 in pup joint 27 will record the oil, gas and water flow rates from the previously fracked zone 34. Flow meter 21 also includes temperature and pressure gauges.

According to an embodiment of the invention, once the flow rate of a fluid in a given frack zone has been measured, the flow rates of fluid in a different normally adjacent zone can be measured by moving the isolation unit to isolate a different frack zone such as frack zone 33 shown in the FIGURE.

The Initial Bottom Hole Pressure will be measured before each zone is tested and the straddle packers isolate that zone. The Flowing Bottom Hole Pressure will be measured when the jet pump is engaged and drawdown is achieved. Consequently, the production index for each frack zone in a producing well can be calculated. Based upon the calculation a determination can be made as to the original frack zones that are most likely to exhibit increased productivity due to a refracking procedure.

Although the present invention and its advantages have been described in detail, it should be understood that various changes, substitutions and alterations may be made herein without departing from the spirit and scope of the invention as defined by the appended claims.

What is claimed is:

1. A method of evaluating the potential effectiveness of refracking a producing oil/gas well that has already been fracked at a plurality of zones along the length of the well comprising:

a) isolating a first producing, previously fracked zone in the well;

b) providing an additional draw down with a jet pump to the isolated previously fracked zone;

c) delivering a power fluid to the jet pump to draw fluid from the fracked zone through a pup joint;

d) measuring the flow rate of fluids, from the fracked zone while the zone is being produced by placing a three phase flow meter in the pup joint in tubing located within the well, the tubing including a perforated pipe positioned between the packers;

e) recording one or more flow rates from the fracked zone f) calculating a production index for the isolated previously fracked zone; and g) determining whether the previously fracked zone is likely to exhibit increased productivity due to a refracking procedure.

2. The method of claim 1, further including measuring an initial bottom hole pressure for the previously fracked zone prior to isolating the zone.

3. The method of claim 2, further including measuring a flowing bottom hole pressure for the previously fracked zone while power fluid is being delivered to the jet pump.

4. The method of claim 1, wherein the producing, previously fracked zone is isolated using the packers at the beginning and end of the zone.

5. The method of claim 4, wherein the packers are either of the inflatable type and a portion of the power fluid for the jet pump is diverted to set the packers.

6. The method of claim 1, wherein the well is a horizontal well.

7. The method of claim 1, further including measuring the temperature and pressure of fluid within the previously fracked zone.

8. The method of claim 1, further including measuring an initial static bottom hole pressure and a flowing bottom hole pressure of the previously fracked zone, measuring a production rate of the previously fracked zone, wherein the production index is calculated by subtracting the flowing bottom hole pressure from the static bottom hole pressure and dividing the production rate by the result of subtracting the flowing bottom hole pressure from the static bottom hole pressure.

9. The method of claim 1, further including the step of refracking the previously fracked zones that are determined to be most likely to exhibit increased productivity.

10. A method of evaluating the potential effectiveness of refracking a producing oil/gas well that has already been fracked at a plurality of zones along the length of the well comprising:

a) isolating a first producing, previously fracked zone in the well, wherein the previously fracked zone is isolated by placing a packer within the well at the beginning and end of the zone;

b) providing an additional draw down with a jet pump to the isolated previously fracked zone;

c) delivering a power fluid to the jet pump to draw fluid from the fracked zone through a pup joint;

d) measuring the flow rate of fluids, from the fracked zone while the zone is being produced by placing a three phase flow meter in the pup joint in tubing located within the well, the tubing including a perforated pipe positioned between the packers;

e) recording oil, gas and water flow rates from the fracked zone f) calculating a production index for the isolated previously fracked zone;

g) determining whether the previously fracked zone is likely to exhibit increased productivity due to a refracking procedure; and, h) repeating steps a)-g) in a second producing, previously fracked zone.

11. The method of claim 10, further including measuring an initial bottom hole pressure for the previously fracked zone prior to isolating the zone.

12. The method of claim 11, further including measuring a flowing bottom hole pressure for the previously fracked zone while power fluid is being delivered to the jet pump.

13. The method of claim 10, wherein the packers are either of the inflatable type or mechanical type and a portion of power fluid for the jet pump is diverted to set the packers.

14. The method of claim 10, wherein the well is a horizontal well.

15. The method of claim 10, further including measuring the temperature and pressure of fluid within the previously fracked zone.

16. The method of claim 10, further including measuring an initial static bottom hole pressure and a flowing bottom hole pressure of the previously fracked zone, measuring a production rate of the previously fracked zone, wherein the production index is calculated by subtracting the flowing bottom hole pressure from the static bottom hole pressure and dividing the production rate by the result of subtracting the flowing bottom hole pressure from the static bottom hole pressure.

17. The method of claim 10, further including the step of refracking the previously fracked zones that are determined to be most likely to exhibit increased productivity.

* * * * *